US009248673B2

(12) United States Patent
Biondo et al.

(10) Patent No.: US 9,248,673 B2
(45) Date of Patent: Feb. 2, 2016

(54) COUNTERFEIT-RESISTANT LABELS AND METHOD

(71) Applicants: William A Biondo, Beverly Hills, MI (US); Frankie K Thomas, Poland, OH (US); Kevin W Snider, Clawson, MI (US)

(72) Inventors: William A Biondo, Beverly Hills, MI (US); Frankie K Thomas, Poland, OH (US); Kevin W Snider, Clawson, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 31 days.

(21) Appl. No.: 13/687,946

(22) Filed: Nov. 28, 2012

(65) Prior Publication Data

US 2014/0009551 A1 Jan. 9, 2014

Related U.S. Application Data

(60) Provisional application No. 61/667,954, filed on Jul. 4, 2012.

(51) Int. Cl.

| | |
|---|---|
| ***B41J 2/01*** | (2006.01) |
| ***B41J 13/00*** | (2006.01) |
| ***B41M 3/14*** | (2006.01) |
| ***G09F 3/00*** | (2006.01) |
| ***B42D 25/29*** | (2014.01) |
| *B42D 25/324* | (2014.01) |
| *B42D 25/333* | (2014.01) |

(52) U.S. Cl.

CPC . *B41J 13/00* (2013.01); *B41M 3/14* (2013.01); *B42D 25/29* (2014.10); *G09F 3/0292* (2013.01); *B42D 25/324* (2014.10); *B42D 25/333* (2014.10); *B42D 2035/14* (2013.01); *B42D 2035/34* (2013.01)

(58) Field of Classification Search

CPC ..... B41J 13/00; B42D 25/29; B42D 25/324; B42D 25/333; B42D 2035/14; B42D 2035/34; B41M 3/14; G09F 3/0292

USPC ..... 347/107, 105, 101, 171, 221; 283/91, 283/85, 86, 93, 94, 72

See application file for complete search history.

(56) References Cited

U.S. PATENT DOCUMENTS

| | | | | |
|---|---|---|---|---|
| 2003/0048347 | A1* | 3/2003 | Miyano | 347/200 |
| 2004/0000787 | A1* | 1/2004 | Vig et al. | 283/113 |
| 2005/0067497 | A1* | 3/2005 | Jones et al. | 235/492 |
| 2008/0292129 | A1* | 11/2008 | Fan et al. | 382/100 |
| 2010/0231980 | A1* | 9/2010 | Chapman et al. | 358/3.28 |

* cited by examiner

*Primary Examiner* — Henok Legesse

(57) ABSTRACT

Improved product labels cannot be easily counterfeited. A plurality of small dots printed on the label are interpreted as dirt or flaw or misprint so that the counterfeit label will not reproduce the plurality of small dots. A first image printed on the label and having a first level of spectural reflectivity, and a second image printed atop the first image using ink having a spectural reflectivity different from the spectural reflectivity of the first image. A plurality of very small dots creates a grayscale field, and a symbol printed within the grayscale field of very small dots, thereby creating a watermark of such high complexity that it cannot be counterfeited. A symbol printed on the label, and a raised dot of ink printed atop the symbol at a precise location to be sensed by finger contact and thereby indicate the authenticity of the label.

2 Claims, 2 Drawing Sheets

COUNTERFEIT-RESISTANT LABELS AND METHOD

FIELD OF THE INVENTION

FIG. 3 shows a label 30. In FIG. 3, an image 34 is printed on the label 30, in the shape of a rectangular field. The image 34 has a certain gloss level by virtue of the printing process and materials used in the manufacture and printing of the label 30. By gloss we mean finish gloss levels, which correspond to the specular reflection of light from the surface. Specular reflection can be thought of as simply the mirror-like reflection of light from a surface.

BACKGROUND OF THE INVENTION

High value consumer products such as electronics, appliances, vehicles, auto parts, clothing, fashion accessories, and jewelry are labeled with various tags, stickers, and serial number plates that contain information such as the name of the manufacturer, date of manufacture, the serial number of the product, the country of origin, etc.

The manufacturers and distributors of genuine products are injured when counterfeiters manufacture imitation products and then label the imitation product with a counterfeit label that wrongfully infringes upon the name, good will, and quality standards of the manufacturer of the genuine products. Manufacturers of genuine products are also injured when consumers or thieves alter or counterfeit the labels in order to change the serial numbers or date of manufacture as part of a scheme to conceal a theft of the product or to make a false claim for warranty or injury.

It would be desirable to provide improved labels that would be difficult to counterfeit and thereby frustrate the counterfeiting and relabeling of high-value consumer products.

SUMMARY OF THE INVENTION

Improved product labels cannot be easily counterfeited. A plurality of small dots printed on the label are interpreted as dirt or a flaw or a misprint so that the counterfeit label will not reproduce the plurality of small dots. A first image is printed on the label and has a first level of spectural reflectivity, and a second image printed atop the first image using ink and has a spectural reflectivity different from the spectural reflectivity of the first image. A plurality of very small dots creates a grayscale field, and a symbol is printed within the grayscale field of very small dots, thereby creating a watermark of such high complexity that it cannot be counterfeited. A symbol is printed on the label, and a raised dot of ink printed atop the symbol at a precise location to be sensed by finger contact and thereby indicate the authenticity of the label.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is merely exemplary in nature and is not intended to limit the invention, its application, or uses.

Figure 1:
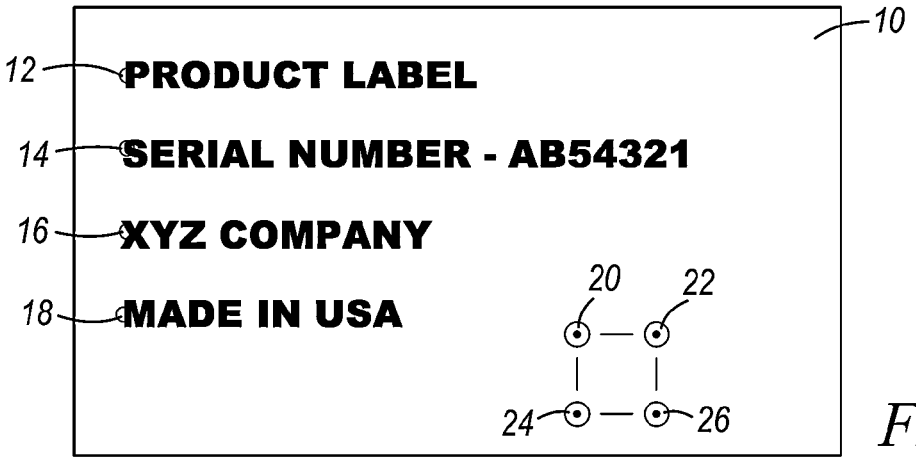
FIG. 1 is a product label having a first embodiment of the invention.

Referring to FIG. 1, label 10 lists the name of the manufacturer, the serial number and the country of origin. Counterfeiters will print a counterfeit replica of this authentic label. The counterfeit label will attempt to exactly match an authentic label, and may also apply a false serial number.

In FIG. 1, seemingly random dots are intentionally printed on the label at 12, 14, 16, 18, 20, 22, 24 and 26. For improved readability of FIG. 1, we have drawn a circle around each of the small dots. The circles would not be printed on the label and are provided here in this drawing simply to improve the readability of this description.

When the counterfeiter looks at the label 10 of FIG. 1, and designs his counterfeit replica, the small dots appear to be speckles of dirt or appear to be an imperfection or mis-print in the printing of the label 10. The counterfeiter will likely either overlook the small dots entirely or will conclude that the small dots are dirt or imperfections which should not be carried over into the design of the counterfeit replica.

Figure 2:
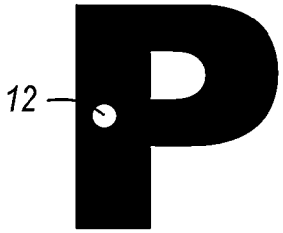
FIG. 2 is an enlargement of a portion of FIG. 1.

Law enforcement personnel or other investigators can be trained to carefully examine a suspected counterfeit and to look for the presence or absence of the small dots. If the small dots 12, 14, 16, 18 20, 22, 24 and 26 are present in a label that is examined, the investigator will conclude that the label is authentic and has not been counterfeited. In order to simplify the training of the law enforcement investigators, it is desirable to display the small dots in a selected pattern. For example, in FIG. 1 the small dots 12, 14, 16 and 18 are small white dots that are concealed in the black ink of the first letter of each line of print. FIG. 2 is an enlargement of the letter P of FIG. 1 to better show the presence of the small white dot hidden in the black ink of the letter P. The small dots 20, 22, 24 and 26 are black dots printed on the white or other color background of the label 10. These dots 20, 22, 24 and 26 are precisely located on the label in a manner that facilitates their recognition by the trained examiner. For example, by connecting the dots 20, 22, 24 and 26 we see that a symbol is formed, in this case a square. The dots can be arranged in a chosen sequence to portray a serial number or other unique identifier such as indicating a time or place of manufacture. Thus the small dots can be openly hidden anywhere on the label, including within the text or on the background. Also, if desired, an image can be printed on the label, such as an image of the product, and the symbol formed by the small dots can be placed within the image.

The small circles drawn around each of the dots in FIG. 1 can be used as a training aid for the law-enforcement personnel. In particular, law-enforcement agencies will be given a printed publication or a computer image containing a reproduction of FIG. 1, and the circles will show the law enforcement personnel exactly where to look for the presence of the small dots that are openly hidden within the label 10.

Figure 3:
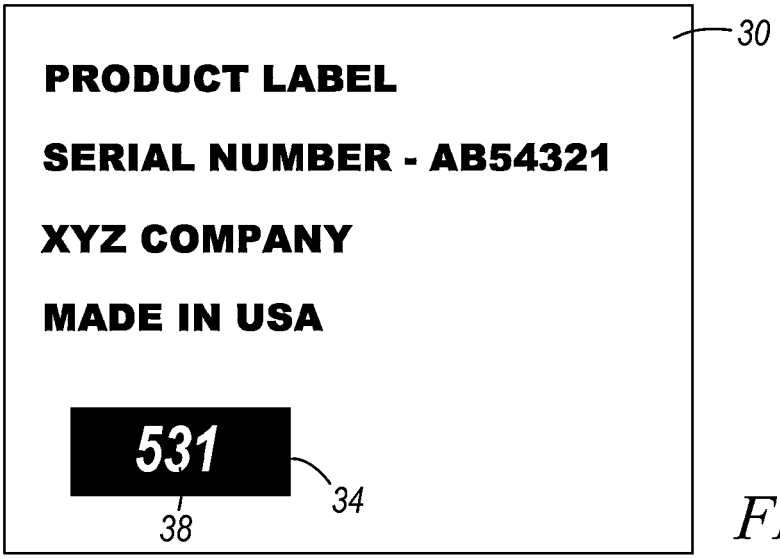
FIG. 3 is a product label having a second embodiment of the invention.

FIG. 3 shows a label 30. In FIG. 3, an image 34 is printed on the label 30, in the shape of a rectangular field. The image 34 has a certain gloss level by virtue of the printing process and materials used in the manufacture and printing of the label 34. By gloss we mean finish gloss levels, which correspond to the specular reflection of light from the surface.

Specular reflection can be thought of as simply the mirror-like reflection of light from a surface.

A watermark symbol, such as alphanumeric image 38 is printed on top of the gloss surface of the image 34. For example, a black printer ribbon is used in a thermal printer to print the alphanumeric image on top of the surface of the image 34. The black ink of the image 38, printed on top of the black ink of the image 34 will be virtually unseen to the counterfeiter. However, an investigator can be trained to use a flashlight to highlight the label and look for the difference in specular reflectivity between images 34 and 38.

In practice then, the counterfeiter will make his counterfeit replica of the label 30 without noticing the image 38. And then the investigator will be able to discern the lack of the image 38 and will conclude that the label being examined has been counterfeited. It will be understood that an alphanumeric is just one example of an image that can be printed atop the image 34. And furthermore, the image 34 is not limited to being a rectangular field, and could, for example, be an image of the product that is being labeled. Thus, any image can be used as the base image 34 and any other alphanumeric or pictorial representation can be printed upon the surface of the base image 34, provided that it have a gloss level that is slightly different from the gloss level of base image 34. Thus, for example, if the top image 38 is the serial number of the product, the difference in magnitude of gloss level is such that the counterfeiter will overlook the presence of the top image 38 and therefore not put his fictitious false serial number atop the base image 34. At the same time, however, the law-enforcement personnel, using a flashlight, can readily distinguish whether an image 38 is printed atop an image 34. In addition, even if the counterfeiter does see the image 38, it is unlikely that the counterfeiter will have access to the label material and the high technology printing equipment needed to effectively accomplish the printing of the second image atop the first image, with the images having different gloss levels.

Figure 4:
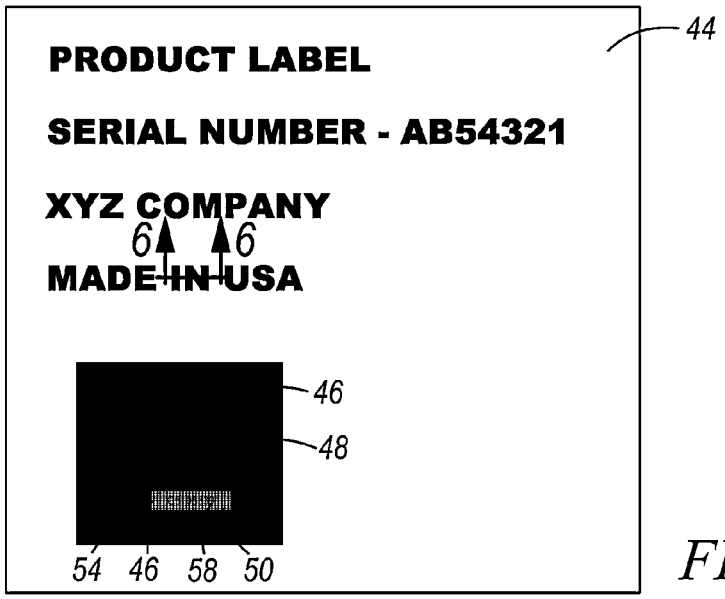
FIG. 4 is a product label having a third embodiment of the invention.
Figure 5:
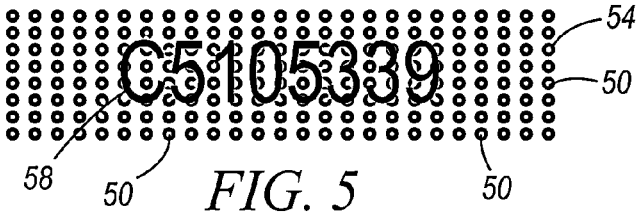
FIG. 5 is an enlargement of a portion of FIG. 4.

FIG. 4 shows another embodiment of the invention. In FIG. 4, a label 44 has a dark image 46 in the form of a black square 48. Within the dark image 46 is a small field in which a plurality of very small black dots 50 are clustered closely together to create a grayscale area 54 in the shape of a rectangle. All or part of the product serial number 58, or some other symbol, is printed inside the rectangular shaped grayscale area 54. FIG. 5 is an enlargement of the portion of FIG. 4 to better show the very small black dots 50 clustered closely together to create a grayscale area 54 and the product serial number 58. Upon designing his counterfeit label, the counterfeiter will observe the dark image 46, the grayscale area 54 formed by the small dots 50, and the serial number 58. In most cases, the counterfeiters are known to use readily available computer hardware such a laser printers, and readily available software such as Microsoft™ PowerPoint™. However, original equipment manufacturers of high quality product labels employ more technically advanced printing equipment such as thermal image printing, and highly sophisticated custom computer programming capable of high precision printing that cannot be replicated by the counterfeiters. Thus the false labels created by the counterfeiters will be readily discernible to a trained investigator because the counterfeiter is unable to replicate the high quality printing of the very small dots 50 creating the grayscale area 54 and the serial number 58 overlying the grayscale area.

In FIG. 4, the grayscale area 54 is placed inside the image 46. However, the small dots 60 can be printed on the white or other colored background of the label 44 to create a grayscale area 64 that is not inside of an image such as image 46.

Figure 6:
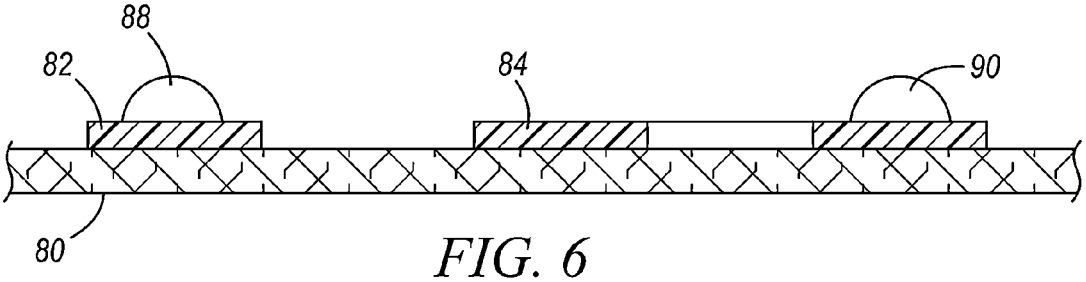
FIG. 6 is an enlarged section view taken in the direction of arrows 6-6 of FIG. 4.

FIG. 6 shows yet another embodiment of the invention. FIG. 6 is a section view taken through the word "IN" of FIG. 6 and is enlarged to show the thickness of the paper 80 on which the label 44 is printed, and the thickness of the layer of ink that is printed onto the paper 80 to form the word IN. In FIG. 6, a dot or deposit of ink 88 is provided on the letter "I" and a deposit of ink 90 provided on the letter "N". These raised deposits of ink 88 and 90 can be discerned by the investigator running his fingers over the label, similar to the well know use of Braille as a means of tactile communication. The counterfeiter will either overlook the presence and purpose of the deposits 88 and 90, or be unable to replicate the deposits 88 and 90 due to using less sophisticated printing equipment. The deposits can be in the shape of a hemispherical dot, ridge, saw tooth, knurl, or other pattern and the presence of the pattern. The pattern can be sensed by touch or sensed visually by brushing the label with powder, similar to dusting for fingerprints.

Thus the invention provides improved labels that would be difficult to counterfeit and thereby frustrates the counterfeiting and relabeling of high-value consumer products.

What is claimed is:

1. A product label that discourages the counterfeiting thereof, comprising a first image printed on the label and having a first level of spectral reflectivity, a second image printed atop the first image by a thermal printer using ink having a spectral reflectivity different from the spectral reflectivity of the first image, the difference in spectral reflectivity being of a magnitude that the counterfeiter is unable to discern the presence of the thermal printed second image and will therefor counterfeit the counterfeit label without the presence of the second image atop the first image, and a trained observer using a light source to highlight the label is able to discern the presence or absence of the second image and thereby distinguish between a label that is counterfeit and a label that is authentic.

2. A method of discouraging the counterfeiting of product labels comprising:

first printing the label with a first image thereon having a first level of spectral reflectivity, and then thermal printing a second image atop the first image using ink having a spectral reflectivity different from the spectral reflectivity of the first image, the difference in spectral reflectivity being of a magnitude that the counterfeiter is unable to discern the presence of the thermal printed second image and will therefor make the counterfeit label without the presence of the second image atop the first image, and a trained observer using a light source to highlight the label is able to discern the presence or absence of the second image and thereby distinguish between a label that is counterfeit and a label that is authentic.

* * * * *